United States Patent [19]

Mitsui et al.

[11] 4,413,054

[45] Nov. 1, 1983

[54] SILVER HALIDE COLOR PHOTOSENSITIVE MATERIALS

[75] Inventors: Akio Mitsui; Kotaro Nakamura, both of Minami-ashigara, Japan

[73] Assignee: Fuji Photo Film Co., Ltd., Kanagawa, Japan

[21] Appl. No.: 363,736

[22] Filed: Mar. 30, 1982

[30] Foreign Application Priority Data

Jul. 7, 1981 [JP] Japan ..... 56-105837

[51] Int. Cl.[3] ..... G03C 1/40

[52] U.S. Cl. ..... 430/555; 430/387; 430/505

[58] Field of Search ..... 430/382, 544, 555, 948, 430/505, 387

[56] References Cited

U.S. PATENT DOCUMENTS

| | | | |
|---|---|---|---|
| 3,227,554 | 1/1966 | Barr et al. | 430/555 |
| 3,892,572 | 7/1975 | Shiba et al. | 430/504 |
| 3,904,413 | 9/1975 | Mowrey | 430/544 |
| 3,990,899 | 11/1976 | Shiba et al. | 430/382 |
| 4,183,752 | 1/1980 | Kuffner | 430/544 |
| 4,246,333 | 1/1981 | Fuseya et al. | 430/544 |
| 4,264,723 | 4/1981 | Ichijima et al. | 430/555 |
| 4,351,897 | 9/1982 | Aoki et al. | 430/555 |

*Primary Examiner*—J. Travis Brown

*Attorney, Agent, or Firm*—Sughrue, Mion, Zinn, Macpeak & Seas

[57] ABSTRACT

A silver halide color photosensitive material is described, containing a 4-arylthio-5-pyrazolone coupler and comprising a layer containing an emulsion of fine silver halide particles.

8 Claims, No Drawings

SILVER HALIDE COLOR PHOTOSENSITIVE MATERIALS

FIELD OF THE INVENTION

The present invention relates to color photosensitive material containing a 2-equivalent magenta coupler.

BACKGROUND OF THE INVENTION

In silver halide color photosensitive materials, it is necessary to use 2-equivalent couplers in order to improve sharpness and developability. Known 2-equivalent magenta couplers include those described in U.S. Pat. No. 3,227,554. Among them, 4-arylthio-5-pyrazolone couplers are advantageously used from the viewpoint of sensitivity and the 2-equivalent property. However, these couplers have a drawback in that reproduction of images is inferior because development in the high density part is slowly carried out and the density is insufficient.

Further, it is not typical for the development processing solution to be newly prepared for every development processing, and the development processing solution is generally used by supplementing a developing solution in amounts corresponding to the rate of consumption thereof. However, the composition of the solution can not be maintained by mere supplement of components lost by the development. Particularly, the composition of the development processing solution, which generally includes a color developing solution, a stopping solution, a bleaching solution, a fixing solution, a bleach-fix solution (Blix), etc., charges to result in a so-called running solution, because (1) the developing agent decomposes over a long period of time because of keeping the processing temperature at a high temperature ranging from 31° to 43° C., (2) the developing agent is oxidized by contact with the air, (3) dissolved substances from the photo-sensitive materials are accumulated during the processing of the photo-sensitive materials, (4) the processing solution is introduced into the next solution by adhesion to the photo-sensitive materials, etc. Therefore, the addition of depleted chemicals and the removal of certain components can be carried out to some extent, but such supplement or recovery is not completely satisfactory. The photo-sensitive materials containing a 4-arylthio-5-pyrazolone coupler have a drawback that the image density (the maximum density part) is particularly difficult to formed, and the black color tends towards a greenish color. Hitherto, no techniques for preventing the lowering of the maximum density have been developed.

Japanese Patent Application (OPI) No. 23228/75 (the term "OPI" as used herein refers to a "published unexamined Japanese patent application") has disclosed the use of a development inhibitor releasing (DIR) coupler together with an emulsion of fine particles. However, this is for the purpose of preventing reduction of the color density in the case of using DIR couplers, which is quite different from the prevention of a retardation of the development rate in high density parts.

SUMMARY OF THE INVENTION

A first object of the present invention is to provide color photosensitive materials having good image reproduction in which the retardation of the development in high density parts in the case of using a 4-arylthio-5-pyrazonone coupler is improved.

A second object is to provide color photosensitive materials having high sensitivity, high sharpness, and excellent image reproduction.

The objects of the present invention have been attained by silver halide color photosensitive materials containing a 4-arylthio-5-pyrazolone magenta coupler and comprising a layer containing an emulsion of fine particles.

DETAILED DESCRIPTION OF THE INVENTION

The emulsion of fine particles is light-sensitive.

The emulsion of fine particles is preferred to have an average particle diameter of from 0.01 to 0.20μ, with the smaller particle size being preferable. Further, it is preferred that the emulsion comprises at least one of silver chloride and silver chlorobromide (silver bromide: 80 mol% or less). The amount added is generally from 0.01 to 1.00 g/m$^2$, and preferably, from 0.02 to 0.30 g/m$^2$.

The emulsion of fine particles may be added to any layer, for example, a 2-equivalent magenta coupler containing silver halide emulsion layer, an adjacent intermediate layer, or a silver halide emulsion layer containing another coupler or an intermediate layer which is further separated from the above described silver halide emulsion layer and it is preferably added to a 2-equivalent magenta coupler containing silver halide emulsion layer or the adjacent layer thereof. However, it is more preferred to incorporate the fine particles in an intermediate layer adjacent to the 4-arylthio-5-pyrazolone magenta coupler containing silver halide emulsion layer.

Couplers where the above-described drawbacks are remarkably improved by the present invention have the formula (I)

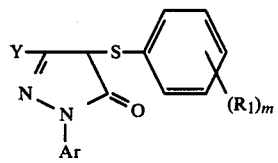

(I)

wherein Ar represents a phenyl group substituted with one or more substituents selected from halogen atoms, alkyl groups, alkoxy groups, alkoxycarbonyl groups, or cyano groups, $R_1$ represents hydrogen, a halogen atom, an acylamino group, a sulfonamido group, a carbamoyl group, a sulfamoyl group, an alkylthio group, an alkoxycarbonyl group, a hydroxyl group, an alkyl group, an alkoxy group, or an aryl group, m represents an integer of from 1 to 5 and $R_1$ may be same or different when m is 2 or more, and Y represents an acylamino group or an anilino group.

Among compounds represented by formula (I), compounds when the above-described drawbacks are particularly remarkably improved by the present invention are those represented by formula (II)

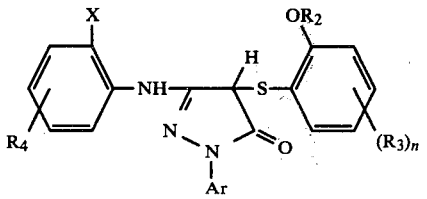

(II)

wherein Ar has the same meaning as in formula (I), $R_2$ represents an alkyl group or an aryl group, X represents a halogen atom or an alkoxy group, $R_5$ represents hydrogen, a hydroxyl group, a halogen atom, an alkyl group, an alkoxy group, or an aryl group, $R_4$ represents hydrogen, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group, or a trichloromethyl group, and n represents an integer of from 1 to 4.

Examples of Ar include a substituted phenyl group, wherein examples of the substituents include halogen atoms (for example, chlorine, bromine, fluorine, etc.), alkyl groups having from 1 to 22 carbon atoms (for example, a methyl group, an ethyl group, a tetradecyl group, a t-butyl group, etc.), alkoxy groups having from 1 to 22 carbon atoms (for example, a methoxy group, an ethoxy group, an octyloxy group, a dodecyloxy group, etc.), an alkoxycarbonyl groups having from 2 to 23 carbon atoms (for example, a methoxycarbonyl group, an ethoxycarbonyl group, a tetradecyloxycarbonyl group, etc.), and a cyano group.

Examples of X include a halogen atom (for example, chlorine, bromine, fluorine, etc.) or an alkoxy group having from 1 to 22 carbon atoms (for example, a methoxy group, an octyloxy group, a dodecyloxy group, etc.).

Examples of $R_4$ include hydrogen, a halogen atom (for example, chlorine, bromine, fluorine, etc.), a straight chain or branched chain alkyl group (for example, a methyl group, a t-butyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a tetradecanamido group, an α-(2,4-di-tert-amylphenoxy)acetamido group, an α-(2,4-di-tert-amylphenoxy)butyramido group, an α-(3-pentyldecylphenoxy)hexanamido group, an α-(4-hydroxy-3-tert-butylphenoxy)tetradecanamido group, a 2-oxopyrolidin-1-yl group, a 2-oxo-5-tetradecylpyrrolicin-1-yl group, a N-methyl-tetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, a N-methyltetradecansulfonamide group, etc.), a sulfamoyl group (for example, a N-methylsulfamoyl group, a N-hexadecylsulfamoyl group, a N-[3-(dodecyloxy)propyl]sulfamoyl group, a N-[4-(2,4-di-tert-amylphenoxy)butyl]sulfamoyl group or a N-methyl-N-tetradecylsulfamoyl group, etc.), a carbamoyl group (for example, a N-methylcarbamoyl group, a N-octadecylcarbamoyl group, a N-[4-(2,4-di-tert-amylphenoxy)butyl]carbamoyl group, a N-methyl-N-tetradecylcarbamoyl group, etc.), a diacylamino group (for example, a N-succinimido group, a N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzensulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), an alkylureido group (for example, a N-methylureido group, a N,N-dimethylureido group, a N-methyl-N-dodecylureido group, a N-hexadecylureido group, a N,N-dioctadecylureido group, etc.), an acyl group (for example, an acetyl group, a benzoyl group, an octadecanoyl group, a p-dodecanamidobenzoyl group, etc.), a nitro group, a carboxyl group, or a trichloromethyl group. In the above described substituents, the alkyl group can have from 1 to 36 carbon atoms and the aryl group has from 6 to 38 carbon atoms.

Examples of $R_2$ include an alkyl group having from 1 to 22 carbon atoms (for example, a methyl group, a propyl group, a butyl group, a 2-methoxyethyl group, a methoxymethyl group, a hexyl group, a 2-ethylhexyl group, a dodecyl group, a hexadecyl group, a 2-(2,4-di-tert-amylphenoxy)ethyl group, a 2-dodecyloxyethyl group, etc.), or an aryl group (for example, a phenyl group, an α- or β-naphthyl group, a 4-tolyl group, etc.).

Examples of $R_3$ include hydrogen, a hydroxyl group, a halogen atom, an alkyl group, an alkoxy group, or an aryl group as in the case of $R_4$.

Among the couplers represented by formula (II), those wherein the total number of carbon atoms in $R_2$ and $R_3$ is 6 or more are particularly preferred for attaining the objects of the present invention.

Examples of typical couplers of the present invention are described in the following, but the present invention is not limited thereto.

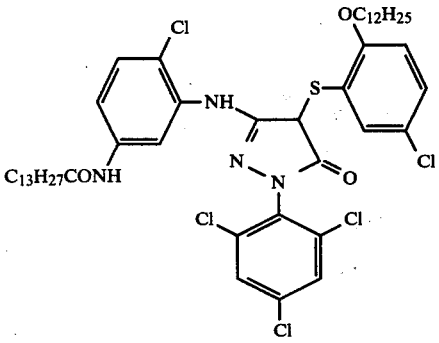
(1)
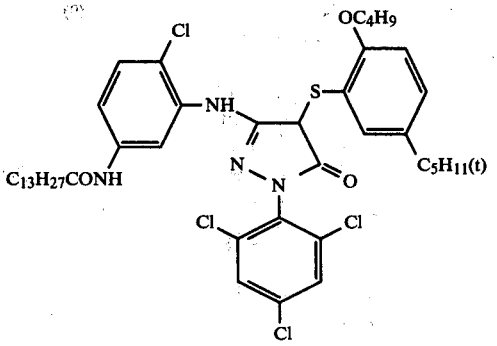
(2)
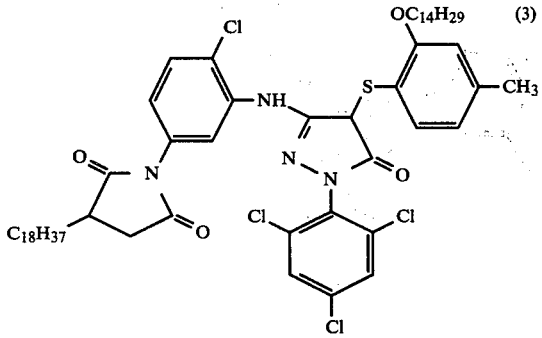
(3)
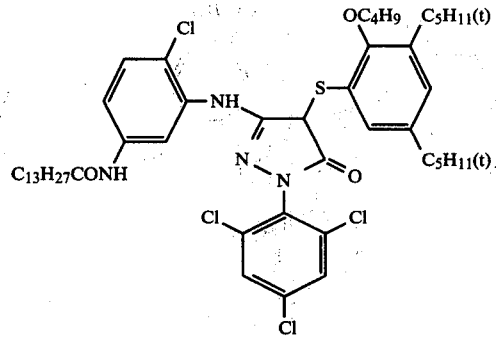
(4)
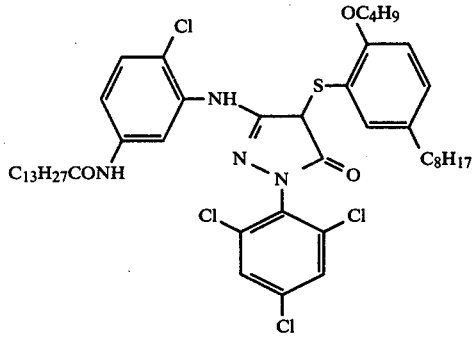
(5)
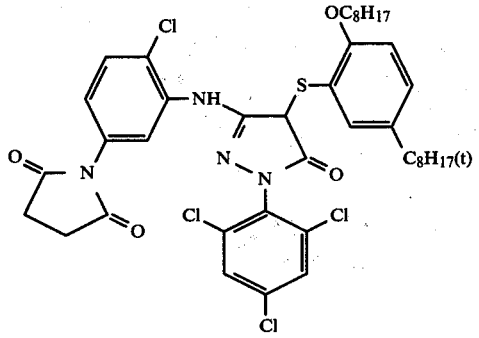
(6)
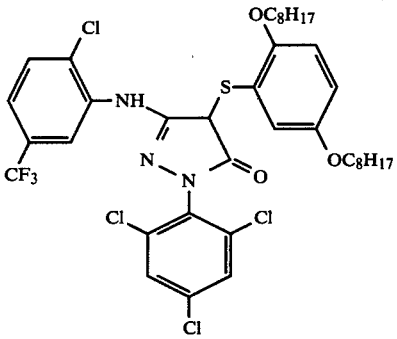
(7)
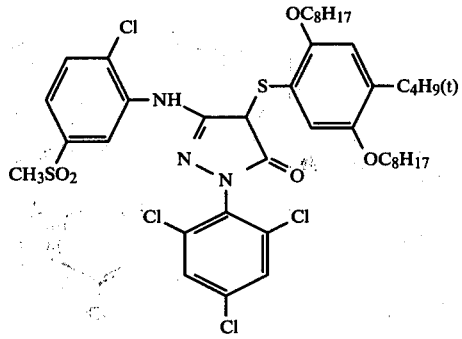
(8)

-continued
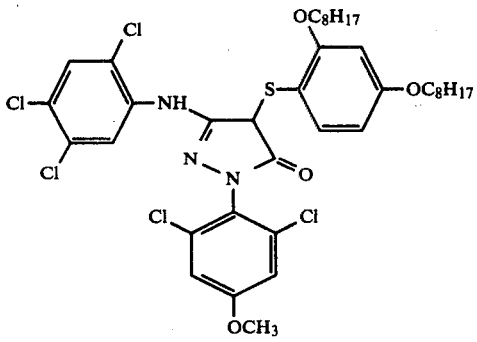
(9)
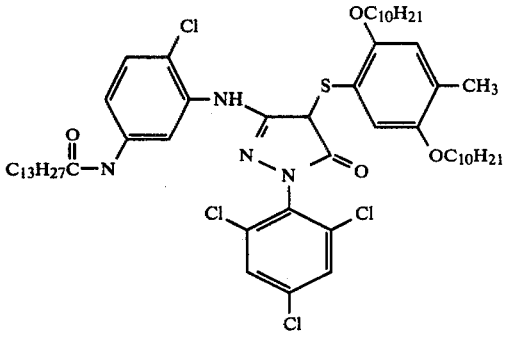
(10)
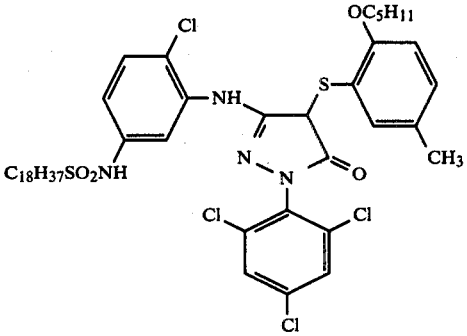
(11)
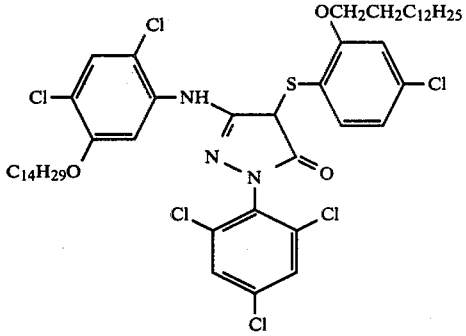
(12)
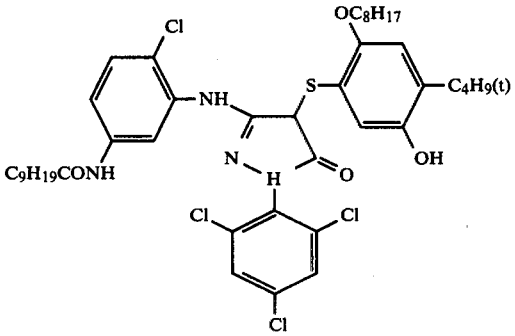
(13)
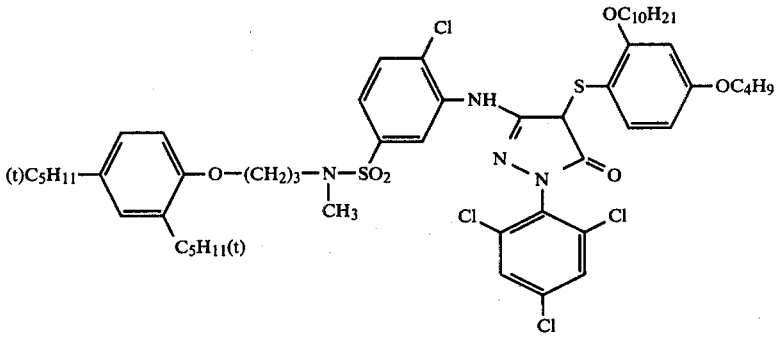
(14)

-continued
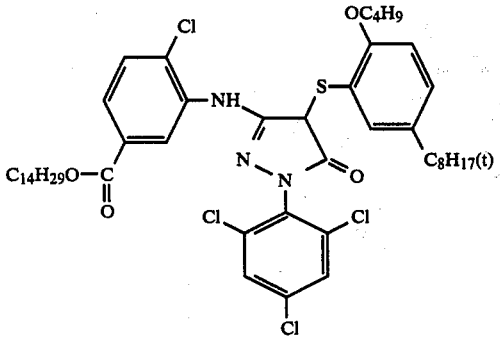
(15)
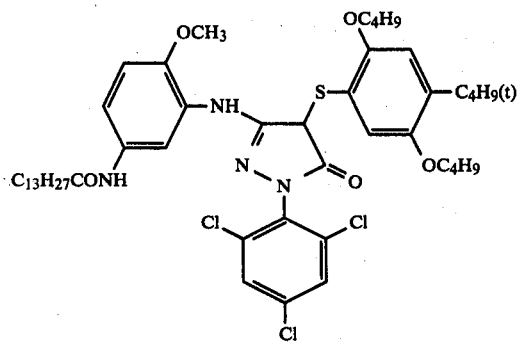
(16)
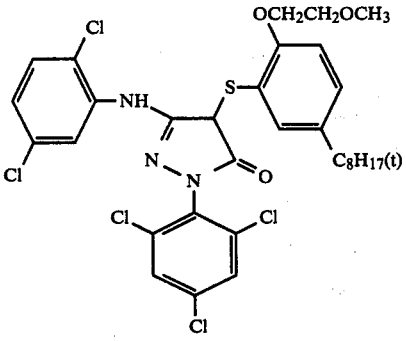
(17)
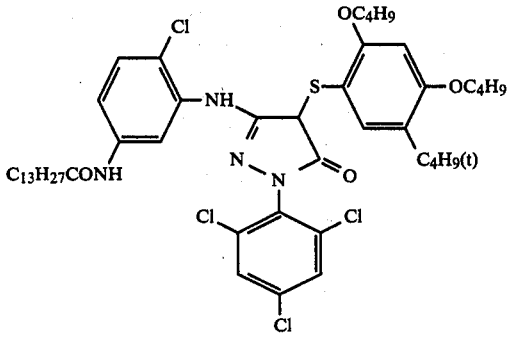
(18)
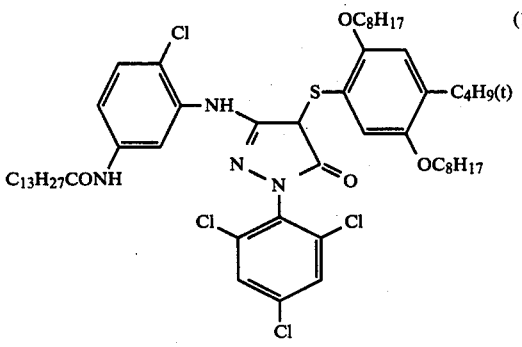
(19)
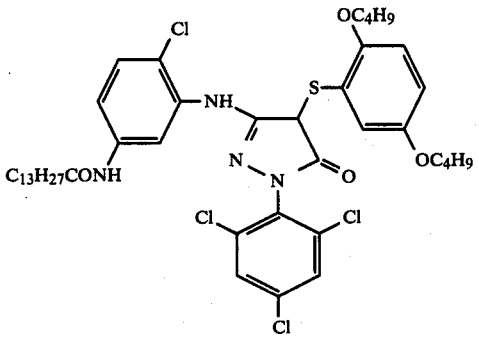
(20)
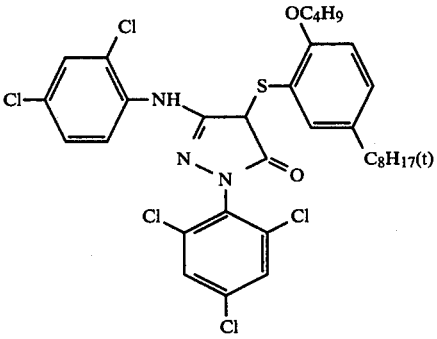
(21)
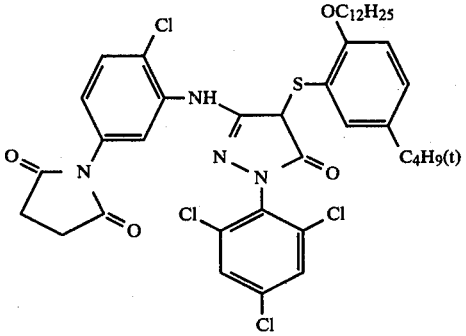
(22)

-continued
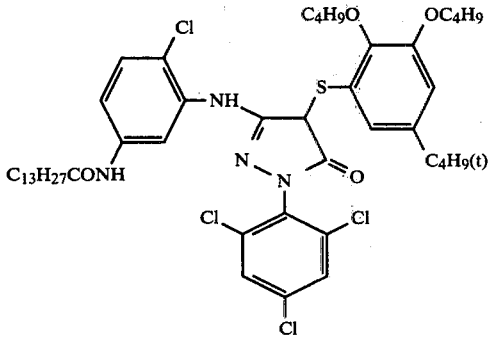
(23)
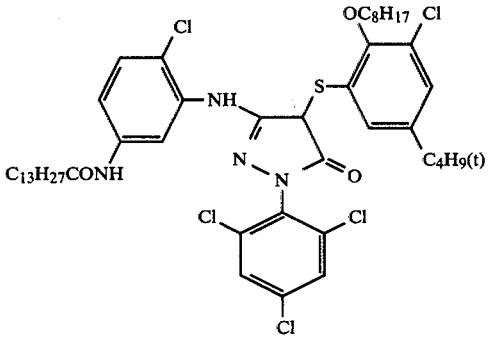
(24)
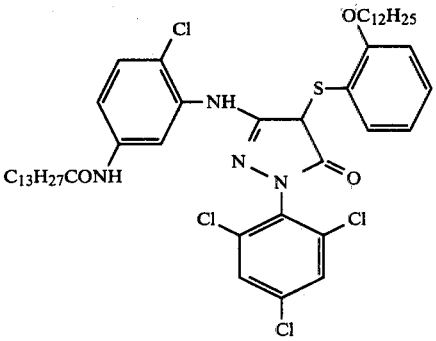
(25)
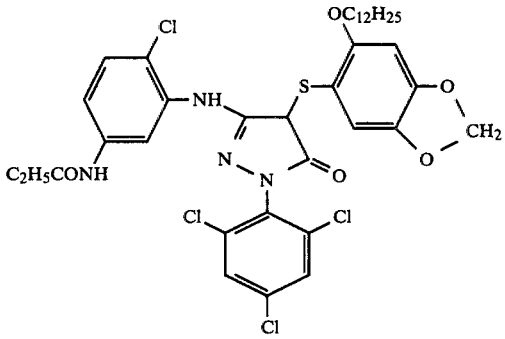
(26)
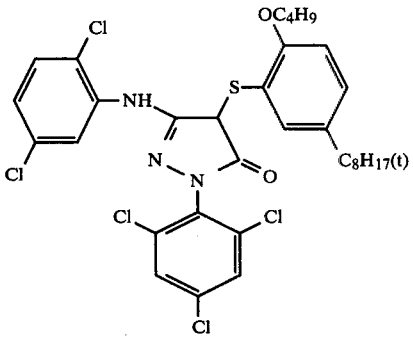
(27)
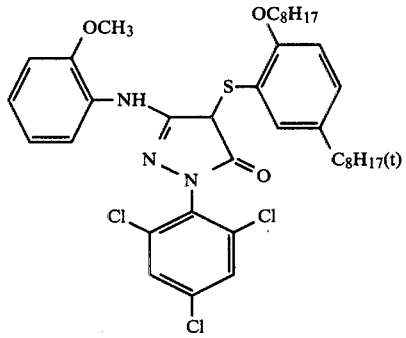
(28)
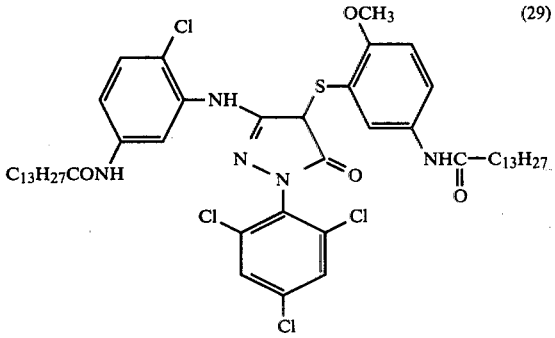
(29)

-continued
(30)
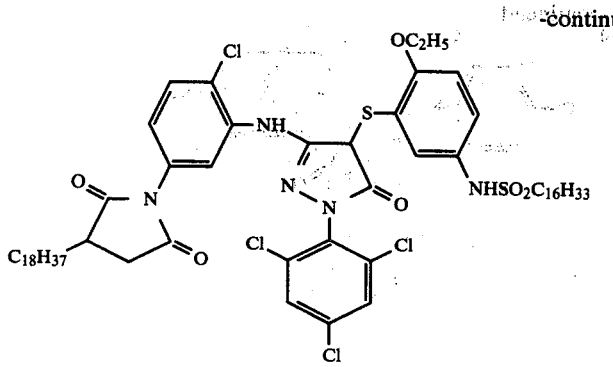
(31)
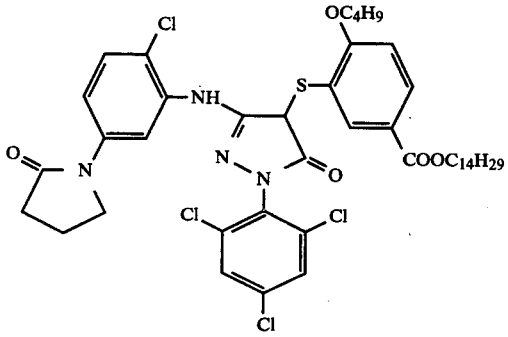
(32)
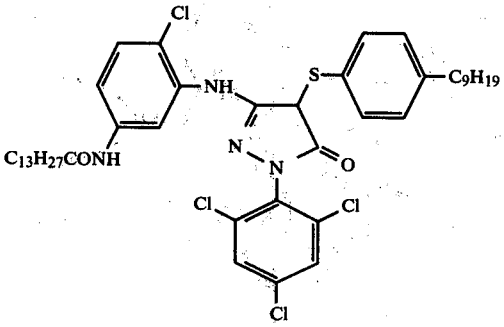
(33)
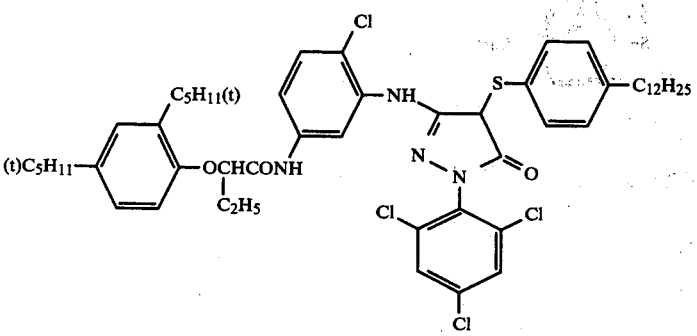
(34)
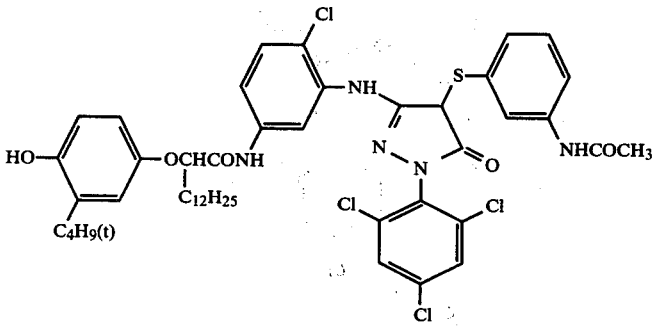
(35)
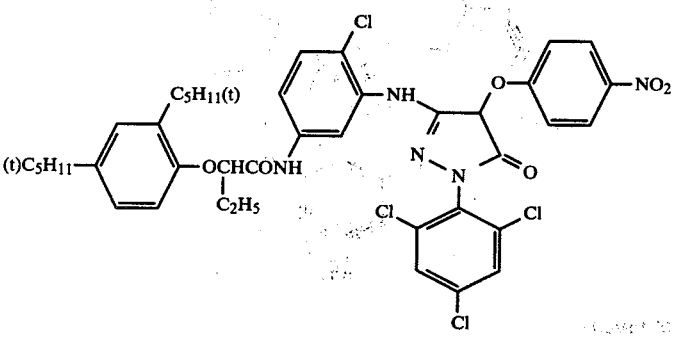

-continued
(36)
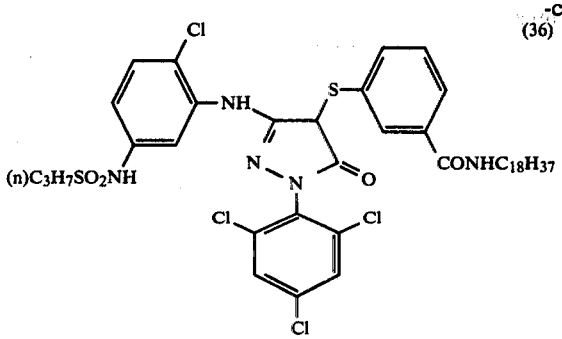
(37)
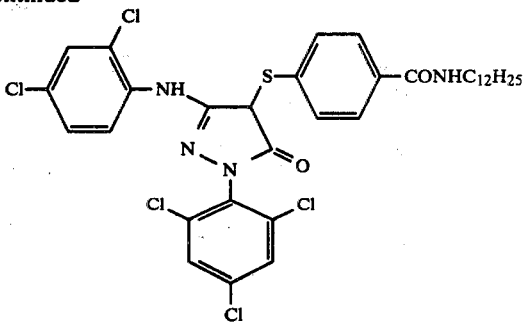
(38)
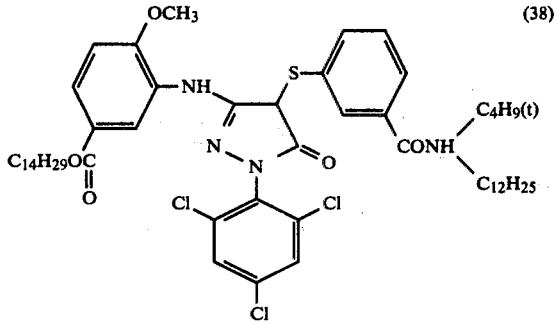
(39)
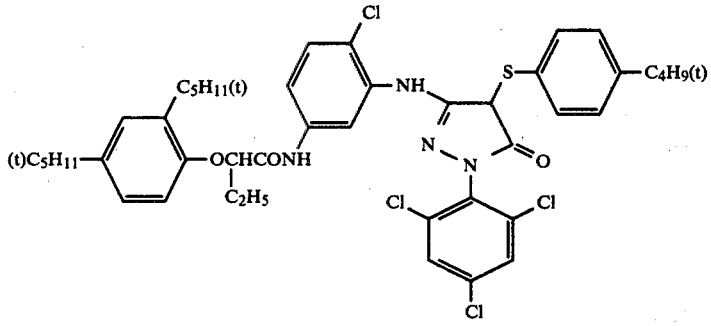
(40)
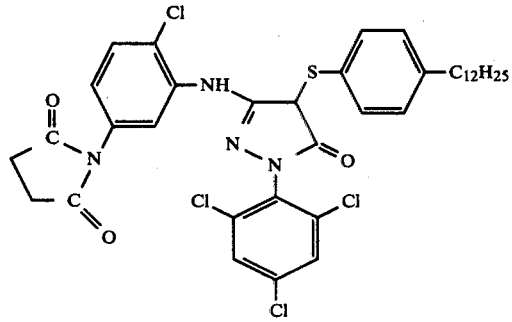
(41)
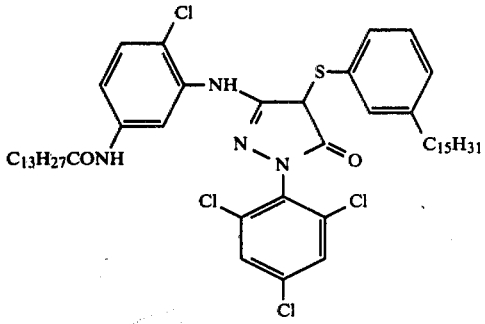
(42)
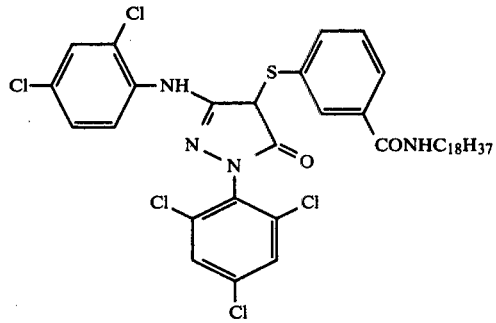
(43)
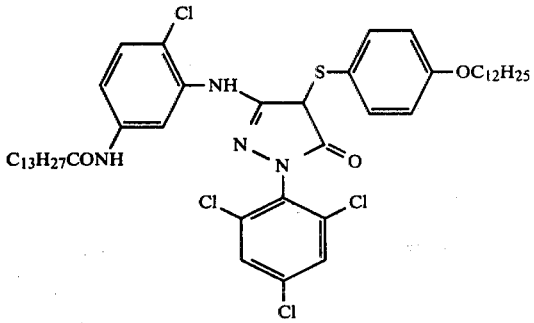
The silver halide emulsion used in the present invention can be prepared by using processes described in P.

A process for forming particles in the presence of excess silver ion (the so-called reverse mixing process) can be used, too. As one double jet process, it is possible to use a process wherein the liquid phase for forming silver halide is kept at a definite pAg, namely, the so-called controlled double jet process.

According to this process, silver halide emulsions having a regular crystal form and nearly uniform particle size can be obtained.

Two or more silver halide emulsions prepared separately may also be blended.

As the couplers used in the present invention, oil soluble couplers are preferred.

For example, as magenta couplers, it is possible to use those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent application (OLS) Nos. 2,408,664, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, and Japanese Patent Application No. 110943/80, etc. together with the magenta coupler represented by the formula (I).

As yellow couplers, benzoylacetanilide compounds and pivaloylacetanilide compounds are advantageously used. Examples of the yellow couplers capable of use include those described in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77, etc.

As cyan couplers, phenol compounds and naphthol compounds can be used. Examples thereof include those described in U.S. Pat. Nos. 2,369,929, 2,434,272, 2,474,293, 2,521,908, 2,895,826, 3,034,892, 3,311,476, 3,458,315, 3,476,563, 3,582,971, 3,591,383, 3,767,411 and 4,004,929, German Patent Application (OLS) Nos. 2,414,830 and 2,454,329 and Japanese Patent Application (OPI) Nos. 59838/73, 26034/76, 5055/73, 146828/76, 69624/77 and 90932/77.

As colored couplers, it is possible to use those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959.

As DIR couplers, it is possible to use those described, for example, in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76.

In addition to DIR couplers, the photosensitive materials may contain compounds which release a development inhibitor at development, and those described in U.S. Pat. Nos. 3,297,445 and 3,379,529, German Patent Application (OLS) No. 2,417,914 and Japanese Patent Application (OPI) Nos. 15271/77 and 9116/78 can be used.

Two or more of the above described couplers may be contained in the same layer. Two or more layers may contain the same compound.

These couplers are added generally in an amount of from $2\times10^{-3}$ mols to $5\times10^{-1}$ mols, and preferably from $1\times10^{-2}$ mols to $5\times10^{-1}$ mols per mol of silver in the emulsion layer.

In order to introduce the coupler used in the present invention into the silver halide emulsion layer, it is possible to use known processes, for example, a process described in U.S. Pat. No. 2,322,027. For example, the coupler is dissolved in alkyl phthalates (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyllaurylamide), aliphatic acid esters (for example, dibutoxyethyl succinate or dioctyl azelate), trimesic acid esters (for example, tributyl trimesate), or organic solvents having a boiling point of from about 30° C. to 150° C., for example, lower alkyl acetates such as ethyl acetate or butyl acetate, ethyl propionate, secondary butyl alcohol, methyl isobutyl ketone, β-ethoxyethyl acetate or methyl cellosolve, etc., and, thereafter, the resulting solution is dispersed in a hydrophilic colloid. The above described organic solvents having a high boiling point may be used as a mixture with the organic solvents having a low boiling point.

A preferred ratio of solvent/coupler is 0/1 to 2/1.

Further, it is possible to use a process for dispersing by polymers described in Japanese Patent Publication No. 39853/76 and Japanese Patent Application (OPI) No. 59943/76.

In the case that the coupler has acid groups such as carboxylic acid group or sulfonic acid group, it is introduced into the hydrophilic colloid as an aqueous alkaline solution thereof.

A subbing layer of the photographic sensitive materials of the present invention is a hydrophilic colloid layer composed of hydrophilic high molecular materials such as gelatin, etc., which is generally provided on a base. Generally, by providing a subbing layer, it is possible to obtain improvement of adhesion to the photographic emulsion layer.

The present invention can be applied to any color photographic sensitive materials requiring the color development processing, for example, color paper, color negative films or color reversal films, etc. Printing sensitive materials (for example, color paper, etc.) are particularly preferred.

In the photographic emulsion layers of the photographic sensitive materials of the present invention, any of silver bromide, silver iodobromide, silver iodochlorobromide, silver chlorobromide and silver chloride may be used as the photographic silver halide.

In the step of formation of silver halide particles or the step of physical aging, cadmium salts, zinc salts, lead salts, thallium salts, iridium salts or complex salts thereof, rhodium salts or complex salts thereof, iron salts or complex salts thereof, etc., may be added thereto.

The photographic emulsions used in the present invention may be spectrally sensitized by methine dyes or others. Dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are dyes belonging to the classed of cyanine dyes, merocyanine dyes, and complex merocyanine dyes. In these dyes, it is possible to utilize any basic heterocyclic nuclei conventionally utilized for cyanine dyes. Namely, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; the above described nuclei to which an alicyclic hydrocarbon ring is fused; and the above described nuclei to which an aromatic hydrocarbon ring is fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on the carbon atoms thereof.

In the merocyanine dyes and the complex merocyanine dyes, it is possible to utilize, as nuclei having a ketomethylene structure, 5- to 6-member heterocyclic nuclei such as a pyrazolin-5-one nucleus, a thiohidantoin nucleus, a 2-thioxazolidin-2,4-dione nucleus, a thiazolidine-2,4-dione nucleus, a rhodanine nucleus, a thiobarbituric acid nucleus, etc.

Examples of useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Pat. No. 1,242,588, and Japanese Patent Publication Nos. 14030/69 and 24844/77.

These sensitizing dyes may be used alone, but combinations of them may be used, too. The combinations of the sensitizing dyes are frequently used for the purpose of supersensitization. Examples thereof have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110,618/77 and 109925/77.

The emulsions may contain dyes which do not have a spectral sensitization function, or substances showing supersensitization which do not substantially absorb visible rays, together with the sensitizing dyes. For example, the emulsions may contain aminostilbene compounds substituted with nitrogen-containing heterocyclic groups (for example, those described in U.S. Pat. Nos. 2,933,390 and 3,635,721), aromatic acid-formaldehyde condensed product (for example, those described in U.S. Pat. No. 3,743,510), cadmium salts and azaindene compounds. Combinations described in U.S. Pat. Nos. 3,615,613, 3,615,641, 3,617,295 and 3,635,721 are particularly useful.

As the binder or protective colloid for the photographic emulsions, gelatin is advantageously used, but other hydrophilic colloids may be used, too.

For example, it is possible to use proteins such as gelatin compounds, graft polymers of gelatin with other polymers, albumin, or casein; saccharides, including cellulose compounds such as hydroxyethyl cellulose, carboxymethyl cellulose, cellulose sulfate, etc., sodium alginate, starch compounds, etc.; and synthetic hydrophilic polymeric substances such as homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As the gelatin, not only lime-processed gelatin, but also acid-processed gelatin, and enzyme-processed gelatin, as described in *Bull. Soc. Sci. Phot. Japan,* No. 16, page 30 (1966) may be used. Further, hydrolyzed products and enzymatic products of gelatin can be used. As the gelatin compounds, it is possible to use those obtained by reacting gelatin with various compounds such as acid halides, acid anhydrides, isocyanates, bromoacetic acid, alkanesulfones, vinylsulfonamides, maleinimides, polyalkylene oxides, epoxy compounds, etc. Examples thereof have been described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

As the above described gelatin graft polymers, it is possible to use those produced by grafting homopolymers or copolymers of vinyl monomers such as acrylic acid, methacrylic acid and compounds thereof such as esters or amides, acrylonitrile, styrene, etc., on gelatin. It is particularly preferred to use graft polymers of gelatin and polymers having some degree of compatibility with gelatin, such as polymers of acrylic acid, methacrylic acid, acrylamide, methacrylamide or hydroxyalkyl methacrylate, etc. Examples thereof have been described in U.S. Pat. Nos. 2,763,625, 2,831,767, 2,956,884, etc.

Examples of typical synthetic hydrophilic polymeric substances include those described in German Patent Application (OLS) No. 2,312,708, U.S. Pat. Nos. 3,620,751 and 3,879,205, and Japanese Patent Publication No. 7561/68.

The present invention can be applied to multilayer multicolor photographic sensitive materials comprising at least two layers having different spectral sensitivities on a base. The multilayer color photographic sensitive materials generally have at least a red-sensitive emulsion layer, a green-sensitive emulsion layer, and a blue-sensitive emulsion layer on the base. The order of these layers may be suitably varied as occasion demands. Generally, for natural color reproduction, the red-sensitive emulsion layer contains a cyan forming coupler, the green-sensitive emulsion layer contains a magenta forming coupler, and the blue-sensitive emulsion layer contains a yellow forming coupler. However, if desired, other combinations may be utilized.

In the photosensitive materials produced according to the present invention, the hydrophilic colloid layers may contain water soluble dyes as filter dyes or for other purposes such as prevention of irradiation. Examples of such dyes include oxonol dyes, hemioxonol dyes, styryl dyes, merocyanine dyes, cyanine dyes, and azo dyes. Among them, oxonol dyes, hemioxonol dyes and merocyanine dyes are particularly useful. Examples of such dyes capable of being used include those described in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In carrying out the present invention, known agents for preventing fading may be used. Further, such dye image stabilizers in the present invention may be used alone, or two or more of them may be used together. Examples of the known agents for preventing fading include hydroquinone compounds as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc., gallic acid compounds as described in U.S. Pat. Nos. 3,457,079, 3,069,262, etc., p-alkoxyphenols as described in U.S. Pat. Nos. 2,735,765 and 3,698,909 and Japanese Patent Publication Nos. 20977/74 and 6623/77, p-oxyphenol compounds as described in U.S. Pat. Nos. 3,432,300, 2,573,050, 3,574,627 and 3,764,337 and Japanese Patent Application (OPI) Nos. 35633/77, 147434/77 and 152225/77, and bisphenols as described in U.S. Pat. No. 3,700,455.

The photosensitive materials according to the present invention may contain hydroquinone compounds, aminophenol compounds, gallic acid compounds and ascorbic acid compounds, etc. as anti-color-fogging agents. Examples thereof have been described in U.S. Pat. Nos. 2,360,290, 2,336,327, 2,403,721, 2,418,613, 2,765,314, 2,701,197, 2,704,713, 2,728,659, 2,732,300 and 2,735,765, Japanese Patent Application (OPI) Nos. 92988/75, 92989/75, 93928/75, 110337/75, and 146235/77, and Japanese Patent Publication No. 23813/75.

In the photosensitive materials according to the present invention, it is preferred that the hydrophilic colloid layers contain ultraviolet ray absorbing agents. For example, it is possible to use benzotriazole compounds substituted by aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71, cinnamic acid esters (for example, those described in U.S. Pat. Nos. 3,705,805 and 3,707,375), butadiene compounds (for example, U.S. Pat. No. 4,045,229), and benzoxazole compounds (for example, those described in U.S. Pat. No. 3,700,455). Further, it is possible to use those described in U.S. Pat. No. 3,499,762 and Japanese Patent Application (OPI) No. 48535/79. Couplers having an ultraviolet ray absorbing property (for example, α-naphthol cyan dye forming couplers) and polymers having an ultraviolet ray absorbing property may be used, too. These ultraviolet ray absorbing agents may be mordanted on a specified layer.

In the photosensitive materials according to the present invention, the photographic emulsion layers and other hydrophilic colloid layers may contain whitening agents such as stilbene, triazine, oxazole, or coumarin compounds. They may be water soluble. Further, water insoluble whitening agents may be used in a dispersed state. Examples of the fluorescent whitening agents include those described in U.S. Pat. Nos. 2,632,701, 3,269,840 and 3,359,102, British Pat. Nos. 852,075 and 1,319,763, etc.

In the photographic sensitive materials of the present invention, the photographic emulsion layers and other hydrophilic colloid layers can be applied to the base or other layers by various known coating processes. Coating can be carried out by a dip coating process, a roller coating process, a curtain coating process or an extrusion coating process, etc. Advantageous processes are those described in U.S. Pat. Nos. 2,681,294, 2,761,791, and 3,526,528.

The photographic processing of the photosensitive materials of the present invention can be carried out by any known process. Known processing solutions can be used. The processing temperature is selected, generally, from 18° C. to 50° C., but a temperature of lower than 18° C. or higher than 50° C. may be used. Known color development processes can be utilized provided that it forms dye images.

The color developing solution is generallycomposed of an alkaline aqueous solution containing a color developing agent. As the color developing agent, known primary aromatic amine developing agents can be used, examples of which include phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, those described in L. F. A. Mason, *Photographic Processing Chemistry* (Focal Press, 1966) pages 226–229, U.S. Pat. Nos. 2,193,015 and 2,592,364, and Japanese Patent Application (OPI) No. 64933/73 may be used.

The color developing solution may contain pH buffer agents such as sulfates, carbonates, borates or phosphates of alkali metals, and development restrainers or antifogging agents such as bromides, iodides, organic antifogging agents, etc. If necessary, it may contain water softeners, preservatives such as hydroxylamine, organic solvents such as benzyl alcohol or ethylene glycol, development accelerators such as as polyethylene glycol, quaternary ammonium salts or amines, dye forming couplers, competitive couplers, fogging agents such as sodium borohydride, thickeners, polycarboxylic acid type chelating agents described in U.S. Pat. No. 4,083,723, and antioxidants described in German Patent Application (OLS) No. 2,622,950, etc.

After carrying out the color development, the photographic emulsion layers are generally subjected to bleaching. The bleaching may be carried out simultaneously with fixation or may be carried out separately. As the bleaching agents, compounds of polyvalent metals such as iron (III), cobalt (III), chromium (VI) or copper (II), etc., peracids, quinones, nitroso compounds, etc., can be used. For example, it is possible to use ferricyanides, bichromates, and organic complex salts of iron (III) or cobalt (III), for example, complex salts of aminopolycarboxylic acids such as ethylenediaminetetraacetic acid, nitrilotriacetic acid or 1,3-diamino-2-propanol tetraacetic acid, etc., or organic acids such as citric acid, tartaric acid, malic acid, etc.; persulfates; permanganates; nitrosophenol; etc. Among them, potassium ferricyanide, (ethylenediaminetetraacetato)iron (III) sodium complex and (ethylenediaminetetraacetato)iron (III) ammonium complex are particularly useful. (Ethylenediaminetetraacetato)iron (III) complexes are useful for both a bleaching solution and a one-bath bleach-fix solution.

To the bleaching solution or the bleach-fix solution, it is possible to add bleaching accelerators as described in U.S. Pat. Nos. 3,042,520 and 3,241,966, and Japanese Patent Publication Nos. 8506/70 and 8836/70, thiol compounds as described in Japanese Patent Application (OPI) No. 65732/78, and various other additives.

The photosensitive materials according to the present invention are preferably processed with the developing solution supplemented or controlled by the method described in Japanese Patent Application (OPI) Nos. 84636/76, 119934/77, 46732/78, 9626/79, 19741/79, 37731/79, 1048/81, 1049/81 and 27142/81.

The bleach-fix solution used for processing the photosensitive materials according to the present invention is preferably that which is regenerated by the processes described in Japanese Patent Application (OPI) Nos. 781/71, 49437/73, 18191/73, 145231/75, 19541/76, 19535/76 and 144620/76 and Japanese Patent Publication No. 23178/76.

EXAMPLE 1

10 g of a magenta coupler, viz., 1-(2,4,6-trichlorophenyl)-3-[(2-chloro-5-tetradecanamido)anilino]-4-[(2-n-butoxy-5-t-octyl)phenylthio]-2-pyrazoline-5-one (Coupler 5) was dissolved in a mixture of 20 ml of tricresyl phosphate and 20 ml of ethyl acetate, and the resulting solution was dispersed by emulsifying it in 100 g of a solution of gelatin containing 8 ml of a 1% aqueous solution of sodium dodecylbenzenesulfonate.

The resulting emulsion was mixed with a green-sensitive silver chlorobromide emulsion (Br: 50 mol%). After adding sodium dodecylbenzenesulfonate as a coating assistant, it was applied to a paper base both faces of which were laminated with polyethylene.

The coating amount of the coupler was 300 mg/m$^2$ and the silver amount was 210 mg/m$^2$ as silver. In the case of using 4-equivalent couplers in Comparative Examples, the silver amount was 420 mg/m$^2$. To the resulting layer, a gelatin protective layer (gelatine: 1 g/m$^2$) was applied to produce Sample a.

A sample wherein 40 mg/m$^2$ of silver chloride particles having an average particle size of 0.08$\mu$ was contained in the gelatin protective layer in Sample a was produced, which was designated as Sample A. Instead of Coupler (5) in Sample A, couplers as described in Table 1 were used to produce Samples B, C, D, E and F, respectively. Samples b, c, d, e and f, corresponding to the above described samples using a gelatine protective layer containing no silver chloride particles were also produced.

These samples A, B, C, D, E, F, a, b, c, d, e and f were each exposed to light through a continuous wedge at 1,000 luxes for 1 second, followed by processing with the following processing solutions.

| | |
|---|---|
| Developing solution | |
| Benzyl alcohol | 15 ml |
| Diethylenetriamine pentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—$\beta$-(methanesulfonamido)ethylaniline, $3/2H_2SO_4$, $H_2O$ | 4.5 g |
| Water to make | 1 liter |
| | pH: 10.1 |
| Bleach-fix solution | |
| Ammonium thiosulfate (70% by weight) | 150 ml |
| $Na_2SO_3$ | 5 g |
| Na(Fe(EDTA)) | 40 g |
| EDTA (ethylenediaminetetraacetic acid) | 4 g |
| Water to make | 1000 ml |
| | pH: 6.8 |

| Processing step | Temperature | Time |
|---|---|---|
| Developing solution | 33° C. | 3 minutes and 30 seconds |
| Bleach-fix solution | 33° C. | 1 minute and 30 seconds |
| Water wash | 28–35° C. | 3 minutes |

Densities of the processed samples were measured by a Macbeth densitometer Type RD-514 (Status AA Filter). Densities at an exposure which was 3.16 times or 10 times the exposure for providing a density 0.2 above the fog value on the resulting characteristic curve are shown in Table 1.

TABLE 1

| Sample | Magenta coupler | Density (10 times) | Density (3.16 times) |
|---|---|---|---|
| A | (5) | 2.52 | 1.29 |
| a | " | 2.30 | 1.28 |
| B | (3) | 2.37 | 1.20 |
| b | " | 2.21 | 1.19 |
| C | (34) | 2.35 | 1.20 |
| c | " | 2.15 | 1.18 |
| D | (41) | 2.40 | 1.25 |
| d | " | 2.24 | 1.22 |
| E | Comparative coupler (I) | 2.52 | 1.40 |
| e | " | 2.50 | 1.38 |
| F | Comparative coupler (II) | 2.39 | 1.25 |
| f | " | 2.38 | 1.24 |
| G | Comparative coupler (III) | 2.39 | 1.23 |
| g | " | 2.39 | 1.23 |

Comparative coupler (I)

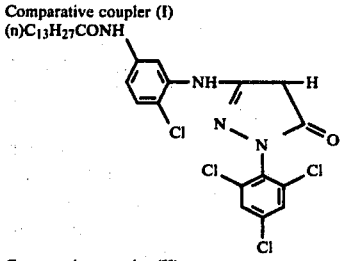

Comparative coupler (II)

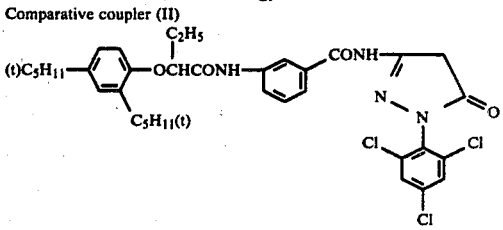

Comparative coupler (III)

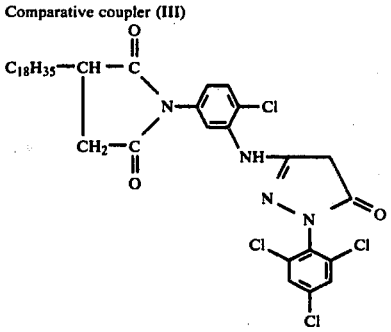

As is clear from Table 1, according to the present invention, the maximum density increases and characteristic curves having good rectilinearity can be obtained even though 2-equivalent magenta couplers are used. In the case of the Comparative couplers, the effect of the emulsion of fine particles is hardly observed, and the rectilinearity is not good.

EXAMPLE 2

A sample as in Example 1 wherein 40 mg/m$^2$ of silver chloride particles having an average particle diameter of 0.08$\mu$ was contained in the emulsion layer containing the magenta coupler in Sample a was produced, and was designated as Sample L. Likewise, samples wherein the fine particles were contained in the emulsion layers of Samples b, c, d, e, f, and g were produced, which were designated as Samples M, N, O, P, Q, and R. These samples were exposed to light through a continuous wedge at 1000 luxes for 1 second, and they were developed with the same processing solutions as in Example 1 by means of a conventional roller transport type developing apparatus, supplementing the processing solutions so as to maintain an equilibrium condition.

Results obtained by measuring by the same method as in Example 1 are shown in Table 2.

TABLE 2

| Sample | Magenta coupler | Density (10 times) |
|---|---|---|
| L | (5) | 2.56 |
| a | " | 2.20 |
| M | (3) | 2.39 |
| b | " | 2.11 |
| N | (34) | 2.37 |
| c | " | 2.02 |
| O | (41) | 2.45 |
| d | " | 2.16 |
| P | Comparative coupler (I) | 2.53 |
| e | " | 2.50 |
| Q | Comparative coupler (II) | 2.39 |
| f | " | 2.38 |
| R | Comparative coupler (III) | 2.39 |
| g | " | 2.39 |

As is clear from Table 2, inferior color formation at the maximum density caused by using the running solution is recovered by means of the present invention, and good density can be obtained. In case of using comparative couplers, virtually no beneficial effect is obtained.

EXAMPLE 3

A coating composition for the third layer shown in Table 3 below was produced using the same magenta coupler as in Example 1 according to the process shown for Sample a of Example 1. Multilayer samples (Samples H–K) comprising this third layer and a fourth layer containing silver chlorobromide as shown in Table 3 were produced.

These samples were exposed to light and processed by the same procedure as in Example 1, and the resulting magenta image was measured similarly.

TABLE 3

| | |
|---|---|
| The 6th layer (Protective layer) | Gelatin (coating amount: 1,000 mg/m$^2$) |
| The 5th layer (Red-sensitive layer) | Silver chlorobromide emulsion (Br: 50% by mol, coating amount: 300 mg/m$^2$ of silver)<br>Gelatin (coating amount: 1,000 mg/m$^2$)<br>Cyan coupler(*1) (coating amount: 400 mg/m$^2$)<br>Solvent for coupler(*2) (coating amount: 200 mg/m$^2$) |
| The 4th layer (Intermediate layer) | Gelatin (coating amount: 1,200 mg/m$^2$)<br>Silver chlorobromide emulsion (average particle diameter: 0.004$\mu$) (Br: 60% by mol)(*8)<br>Ultraviolet ray absorbing agent(*3) (coating amount: 1,000 mg/m$^2$)<br>Solvent for ultraviolet ray absorbing agent(*2) (coating amount: 250 mg/m$^2$) |
| The 3rd layer (Green-sensitive layer) | Silver chlorobromide emulsion (Br: 50% by mol, coating amount: 200 mg/m$^2$ of silver)<br>Magenta coupler(*4) (coating amount: 300 mg/m$^2$)<br>Solvent for coupler(*5) (coating amount: 600 mg/m$^2$)<br>Gelatin (coating amount: 1,000 mg/m$^2$) |
| The 2nd layer (Intermediate layer) | Gelatin (coating amount: 1,000 mg/m$^2$) |
| The 1st layer (Blue-sensitive layer) | Silver chlorobromide emulsion (Br: 80% by mol; coating amount: 400 mg/m$^2$ of silver)<br>Yellow coupler(*6) (coating amount: 300 mg/m$^2$)<br>Solvent for coupler(*7) (coating amount: 150 mg/m$^2$)<br>Gelatin (coating amount: 1,200 mg/m$^2$) |
| Base | Paper base the both faces of which were laminated with polyethylene. |

(*1)Coupler: 2-[α-(2,4-di-tert-pentylphenoxy)butanamido]-4,6-dichloro-5-methylphenol.
(*2)Solvent: Dibutyl phthalate.
(*3)Ultraviolet ray absorbing agent: 2-(2-hydroxy-3-sec-butyl-5-tert-butylphenyl)-benzotriazole.
(*4)Coupler: 1-(2,4,6-Trichlorophenyl)-3-(2-chloro-5-tetradecanamido)anilino-4-[(2-n-buthoxy-5-t-octyl)phenylthio]-2-pyrazolin-5-one.
(*5)Solvent: Tricresyl phosphate
(*6)Coupler: α-Pivaloyl-α-(2,4-dioxo-5,5'-dimethyloxazolidin-3-yl)-2-chloro-5-[α-(2,4-di-tert-pentylphenoxy)butanamido]acetanilide.
(*7)Solvent: Dioctylbutyl phosphate.
(*8)Coating amount is shown in Table 4.

TABLE 4

| Sample | Amount of emulsion of fine particles added mg/m$^2$ | Density (10 times of exposure) |
|---|---|---|
| H | 0 | 2.30 |
| I | 10 | 2.40 |
| J | 40 | 2.54 |
| K | 100 | 2.57 |

It is clear from Table 4 that the effect of the present invention is observed even in multilayer constructions.

While the invention has been described in detail and with reference to specific embodiments thereof, it will be apparent to one skilled in the art that various changes and modifications can be made therein without departing from the spirit and scope thereof.

What is claimed is:

1. A silver halide color photosensitive material containing a 4-arylthio-5-pyrazolone coupler represented by Formula (I)

(I)

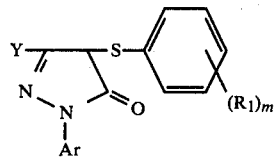

wherein Ar represents a phenyl group substituted with one or more substituents selected from halogen atoms, alkyl groups, alkoxy groups, alkoxycarbonyl groups, or cyano groups, $R_1$ represents hydrogen, a halogen atom, an acylamino group, a sulfonamido group, a carbomoyl group, a sulfamoyl group, an alkylthio group, an alkoxycarbonyl group, a hydroxyl group, an alkyl group, an alkoxy group, or an aryl group, m represents an integer of from 1 to 5 and $R_1$ may be same or different when m is 2 or more, and Y represents an acylamino group or an anilino group and said silver halide coupler photosensitive material comprising a layer containing an emulsion of light-insensitive fine silver halide particles having an average particle diameter from 0.01 to 0.20$\mu$.

2. A silver halide color photosensitive material as in claim 1, wherein the coupler according to Formula (I) is represented by Formula (II)

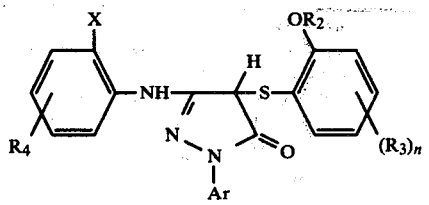

(II)

wherein Ar has the same meaning as in Formula (I), $R_2$ represents an alkyl group or an aryl group, X represents a halogen atom or an alkoxy group, $R_3$ represents hydrogen, a hydroxyl group, a halogen atom, an alkyl group, an alkoxy group, or an aryl group, $R_4$ represents hydrogen, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, an alkylureido group, an acyl group, a nitro group, a carboxyl group, or a trichloromethyl group, and n represents an integer of from 1 to 4.

3. A silver halide color photosensitive material as in claim 1 or 2, wherein the emulsion of fine silver halide particles contains at least one of silver chloride and silver chlorobromide (silver bromide: 80 mol% or less) and the concentration of fine silver halide particles is from 0.01 to 1.0 g/m$^2$.

4. A silver halide color photosensitive material as in claim 1 or 2, wherein the emulsion of fine silver halide particles contains at least one of silver chloride and silver chlorobromide (silver bromide: 80 mol% or less) and the concentration of fine silver halide particles is from 0.02 to 0.30 g/m$^2$.

5. A silver halide color photosensitive material as in claim 1 or 2, wherein the layer containing an emulsion of fine silver halide particles is the 4-arylthio-5-pyrazolone magneta coupler containing silver halide emulsion layer or the adjacent layer thereof.

6. A silver halide color photosensitive material as in claim 1, wherein the layer containing an emulsion of fine silver halide particles is the 4-arylthio-5-pyrazolone magenta coupler containing silver halide emulsion layer or the adjacent layer thereof.

7. A silver halide color photosensitive material as in claim 3, wherein the layer containing an emulsion of fine silver halide particles is the 4-arylthio-5-pyrazolone magenta coupler containing silver halide emulsion layer or the adjacent layer thereof.

8. A silver halide color photosensitive material as in claim 4, wherein the layer containing an emulsion of fine silver halide particles is the 4-arylthio-5-pyrazolone magenta coupler containing silver halide emulsion layer or the adjacent layer thereof.

* * * * *